US005823659A

United States Patent [19]

Klose

[11] Patent Number: 5,823,659

[45] Date of Patent: Oct. 20, 1998

[54] DECORATIVE LIGHT SYSTEM

[76] Inventor: Robert W. Klose, 615 E. Broadway, #306, Long Beach, Calif. 90802

[21] Appl. No.: 917,315

[22] Filed: Aug. 25, 1997

[51] Int. Cl.[6] ..... F21P 1/02

[52] U.S. Cl. ..... 362/252; 362/249; 362/123; 362/806

[58] Field of Search ..... 362/123, 806, 362/252, 250, 249

[56] References Cited

U.S. PATENT DOCUMENTS 5,424,925 6/1995 Jenke et al. ..... 362/123

5,662,409 9/1997 Huang ..... 362/123

5,712,002 1/1998 Reilly, III ..... 362/123

*Primary Examiner*—Thomas M. Sember

[57] ABSTRACT

A decorative light system including an assembly with a plurality of linear strands each having a first end coupled to a first end of each of the remaining strands and a second free end extending downwardly and outwardly to define a cone. Next provided is a single continuous string of light bulbs including a double strand wire having a plurality of bulbs connected thereto. The wire is configured and mounted on the assembly to define a plurality circular portions each residing in an associated horizontal plane and having a unique diameter and elevation.

1 Claim, 2 Drawing Sheets

DECORATIVE LIGHT SYSTEM

BACKGROUND OF THE INVENTION

1. Field of the Invention

The present invention relates to a decorative light system and more particularly pertains to allowing the convenient mounting of a plurality of equally spaced lights on a Christmas tree.

2. Description of the Prior Art

The use of Christmas tree lights is known in the prior art. More specifically, Christmas tree lights heretofore devised and utilized for the purpose of decorating a tree are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,736,282; U.S. Pat. No. 5,057,976; U.S. Pat. Des. 358,673; U.S. Pat. No. 4,870,547; U.S. Pat. No. 4,720,773; and U.S. Pat. No. 4,404,621.

In this respect, the decorative light system according to the present invention substantially departs from the conventional concepts and designs of the prior art, and in so doing provides an apparatus primarily developed for the purpose of allowing the convenient mounting of a plurality of equally spaced lights on a Christmas tree.

Therefore, it can be appreciated that there exists a continuing need for a new and improved decorative light system which can be used for allowing the convenient mounting of a plurality of equally spaced lights on a Christmas tree. In this regard, the present invention substantially fulfills this need.

SUMMARY OF THE INVENTION

In view of the foregoing disadvantages inherent in the known types of Christmas tree lights now present in the prior art, the present invention provides an improved decorative light system. As such, the general purpose of the present invention, which will be described subsequently in greater detail, is to provide a new and improved decorative light system which has all the advantages of the prior art and none of the disadvantages.

To attain this, the present invention essentially comprises an assembly with a plurality of linear insulated strands. As shown in FIG. 2, each strand has a first end coupled to a first end of each of the remaining strands and a second free end extending downwardly and outwardly to define a cone. Next provided is a single continuous string of light bulbs including a double strand wire having a plurality of bulbs connected thereto. Such interconnection is accomplished in a parallel configuration. The wire is configured and mounted on the assembly to define a plurality circular portions each residing in an associated horizontal plane. It should be noted that each circular portion has a unique diameter and elevation. Each circular portion is in electrical communication with an adjacent circular portion thereabove via an associated upwardly and inwardly extending linear portion of the wire. Each upwardly and inwardly extending linear portions is situated along an associated one of the strands of the assembly. For allowing the releasably coupling with a standard electrical receptacle, the wire has a first end connected to a plug and a second end situated at an apex of the cone defined by the assembly. As show in FIG. 1, the bulbs are spaced a greater distance closer to the second end of the wire than the first end thereof. By this structure, each bulb is situated at an intersection of the wire and each strand of the assembly. Ideally, the wire and strands are coupled at such intersections.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved decorative light system which has all the advantages of the prior art Christmas tree lights and none of the disadvantages.

It is another object of the present invention to provide a new and improved decorative light system which may be easily and efficiently manufactured and marketed.

It is a further object of the present invention to provide a new and improved decorative light system which is of a durable and reliable construction.

An even further object of the present invention is to provide a new and improved decorative light system which is susceptible of a low cost of manufacture with regard to both materials and labor, and which accordingly is then susceptible of low prices of sale to the consuming public, thereby making such decorative light system economically available to the buying public.

Still yet another object of the present invention is to provide a new and improved decorative light system which provides in the apparatuses and methods of the prior art some of the advantages thereof, while simultaneously overcoming some of the disadvantages normally associated therewith.

Still another object of the present invention is to allow the convenient mounting of a plurality of equally spaced lights on a Christmas tree.

Lastly, it is an object of the present invention to provide a new and improved decorative light system including an assembly with a plurality of linear strands each having a first end coupled to a first end of each of the remaining strands and a second free end extending downwardly and outwardly to define a cone. Next provided is a single continuous string of light bulbs including a double strand wire having a plurality of bulbs connected thereto. The wire is configured and mounted on the assembly to define a plurality circular portions each residing in an associated horizontal plane and having a unique diameter and elevation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
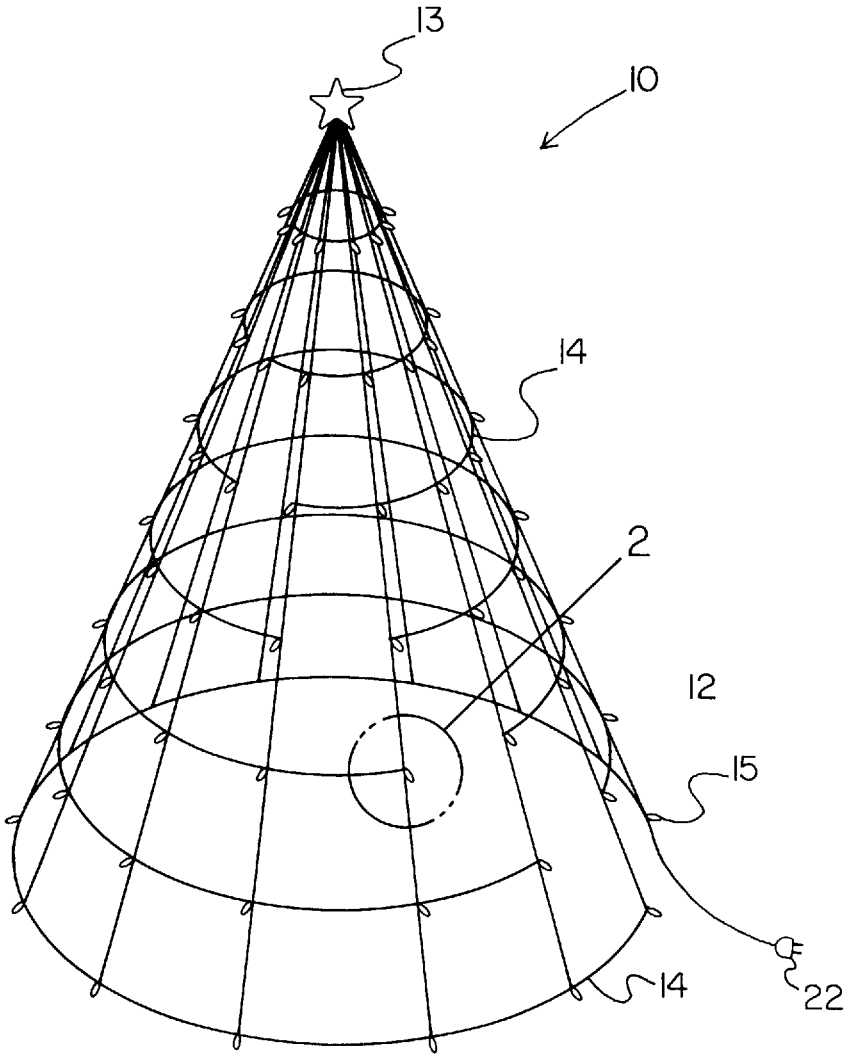
FIG. 1 is an illustration of the preferred embodiment of the decorative light system constructed in accordance with the principles of the present invention.

With reference now to the drawings, and in particular to FIG. 1 thereof, a new and improved decorative light system embodying the principles and concepts of the present invention and generally designated by the reference numeral 10 will be described.

The present invention, the new and improved decorative light system, is comprised of a plurality of components. Such components in their broadest context include an assembly and a string of wires. Such components are individually configured and correlated with respect to each other so as to attain the desired objective.

Figure 2:
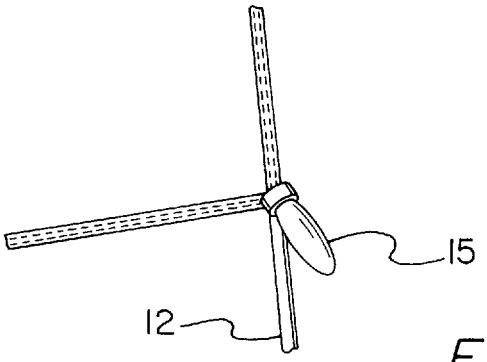
FIG. 2 is a front view of an intersection between the wire and one of the associated strands.

More specifically, it will be noted that the system 10 of the present invention includes an assembly 12 comprising a plurality of linear insulated strands. The strands may be formed of a resilient or flexible material. As shown in FIG. 2, each strand has a first end coupled to a first end of each of the remaining strands and a second free end extending downwardly and outwardly to define a cone. Ideally, each of the strands are equally spaced and are of a quantity of at least fifteen. As an option, an ornament 13 may be mounted on the apex of the assembly.

Figure 3:
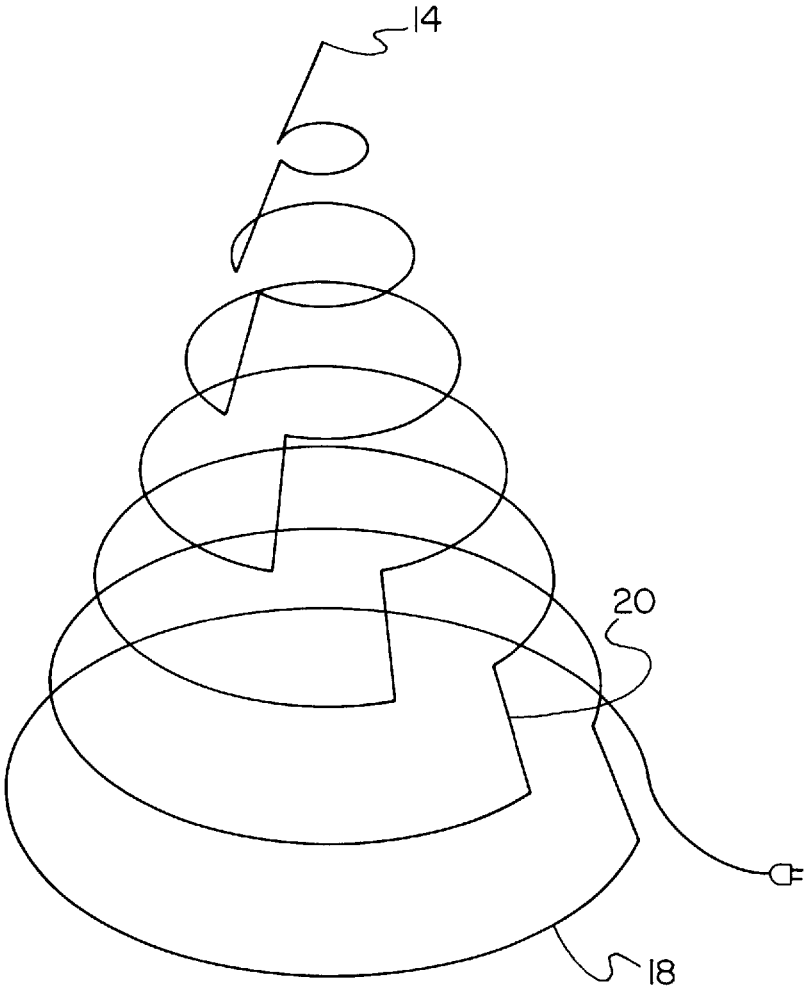
FIG. 3 is a perspective view of only the wire of the present invention.
Figure 4:
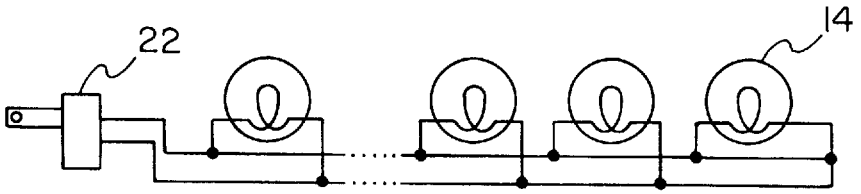
FIG. 4 is a schematic diagram of the present invention.

Next provided is a single continuous string 14 of light bulbs 15 including a double strand wire 16 having a plurality of bulbs connected thereto. Such interconnection is accomplished in a parallel configuration. Note FIG. 4. The wire is configured and mounted on the assembly to define a plurality circular portions 18 each residing in an associated horizontal plane, as shown in FIG. 3. It should be noted that each circular portion has a unique diameter and elevation. As shown in FIG. 2, the circular portions of the wire reside in perpendicular relationship with the strands of the assembly. Preferably, there are at least 6 circular portions.

With reference still to FIG. 3, it is shown that each circular portion is in electrical communication with an adjacent circular portion thereabove via an associated upwardly and inwardly extending linear portion 20 of the wire. Each upwardly and inwardly extending linear portion is situated along an associated one of the strands of the assembly.

For allowing the releasably coupling with a standard electrical receptacle, the wire has a first end connected to a plug 22. A second end of the wire is situated at the apex of the cone defined by the assembly.

As show in FIG. 1, the bulbs are spaced a greater distance closer to the second end of the wire than the first end thereof. By this structure, each bulb is situated at an intersection of the wire and each strand of the assembly. Ideally, the wire and strands are coupled at each of such intersections. Since the diameter of the wire is longer at a lower extent of the assembly, there are more bulbs adjacent such lower extent.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved decorative light system comprising, in combination:

an assembly comprising a plurality of resilient linear insulated strands each having a first end coupled to a first end of each of the remaining strands and a second free end extending downwardly and outwardly to define a cone, wherein the strands are equally spaced and are of a quantity of at least 15 with an ornament mounted on an apex of the assembly; and a single continuous string of light bulbs including a double strand wire having a plurality of bulbs connected to the wire in a parallel configuration, the wire configured and mounted on the assembly to define at least 6 circular portions each residing in an associated horizontal plane and having a unique diameter and elevation, each circular portion being in electrical communication with an adjacent circular portion thereabove via an associated upwardly and inwardly extending linear portion, the wire having a first end connected to a plug for releasably coupling with a standard electrical receptacle and a second end situated at an apex of the cone defined by the assembly;

said bulbs spaced a greater distance closer to the first end of the wire than the second end thereof, whereby each bulb is situated at an intersection of the wire and each strand of the assembly;

said upwardly and inwardly extending linear portions each extending along an associated one of the strands of the assembly.

* * * * *